US008418749B2

(12) United States Patent
Toh et al.

(10) Patent No.: US 8,418,749 B2
(45) Date of Patent: Apr. 16, 2013

(54) CONTINUOUS CASTING APPARATUS FOR STEEL

(75) Inventors: Takehiko Toh, Tokyo (JP); Hideaki Yamamura, Tokyo (JP); Kenji Umetsu, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/126,948

(22) PCT Filed: Nov. 4, 2009

(86) PCT No.: PCT/JP2009/005861

§ 371 (c)(1),
(2), (4) Date: Apr. 29, 2011

(87) PCT Pub. No.: WO2010/052906

PCT Pub. Date: May 14, 2010

(65) Prior Publication Data

US 2011/0209847 A1 Sep. 1, 2011

(30) Foreign Application Priority Data

Nov. 4, 2008 (JP) ..... 2008-282981

(51) Int. Cl.
*B22D 11/115* (2006.01)

(52) U.S. Cl.
USPC ..... 164/504; 164/418; 164/459; 164/468

(58) Field of Classification Search ..... 164/418, 164/459, 466–468, 502–504
See application file for complete search history.

(56) References Cited

U.S. PATENT DOCUMENTS

| | | | | |
|---|---|---|---|---|
| 5,460,220 | A * | 10/1995 | Coassin | 164/483 |
| 5,598,885 | A * | 2/1997 | Meroni et al. | 164/478 |
| 5,730,207 | A * | 3/1998 | Pleschiutschnigg | 164/459 |
| 6,938,674 | B2 * | 9/2005 | Eriksson | 164/466 |

FOREIGN PATENT DOCUMENTS

| | | | |
|---|---|---|---|
| JP | 2000-271710 | A | 10/2000 |
| JP | 2003-164948 | A | 6/2003 |
| JP | 2004-42063 | A | 2/2004 |

OTHER PUBLICATIONS

International Search Report, dated Jan. 12, 2010 in PCT/JP2009/005861.

* cited by examiner

*Primary Examiner* — Kevin P Kerns
*Assistant Examiner* — Kevin E Yoon
(74) *Attorney, Agent, or Firm* — Birch, Stewart, Kolasch & Birch, LLP

(57) ABSTRACT

A continuous casting device for steel of the present invention includes a casting mold for casting a molten steel, a submerged entry nozzle, an electromagnetic stirring device, and an electromagnetic brake device. Further, a curved portion which is curved toward the electromagnetic stirring device is formed at least at a position where the curved portion faces the submerged entry nozzle, on each of the long side walls. Moreover, the horizontal distance between a top of the curved portion and the submerged entry nozzle in plan view is equal to or more than 35 mm and less than 50 mm.

1 Claim, 7 Drawing Sheets

PRIOR ART

CONTINUOUS CASTING APPARATUS FOR STEEL

TECHNICAL FIELD

The present invention relates to a continuous casting apparatus for steel which supplies molten steel into a casting mold to manufacture a cast. This application claims priority based on Japanese Patent Application No. 2008-282981 filed in the Japanese Patent Office on Nov. 4, 2008, the contents of which are incorporated herein by reference.

BACKGROUND ART

In a continuous casting process for steel, for example, application of a direct current magnetic field to molten steel discharged into a casting mold is performed for the purpose of quality improvement of a cast. It is known that a counterflow toward the direction opposite to a main stream is generated around a discharge flow of molten steel in this direct current magnetic field.

In normal continuous casting of molten steel, as shown in FIG. 7 for example, a submerged entry nozzle 102 which discharges molten steel 100 into a casting mold 101 is used. Discharge holes 103 which are pointed downward with respect to the horizontal direction are formed at two locations in the vicinity of a lower end of a side face of the submerged entry nozzle 102. Also, in order to clean the inside of the submerged entry nozzle 102, the molten steel 100 is discharged into the casting mold 101 from the discharge holes 103 while blowing non-oxidized gas such as Ar gas (argon gas). In a case where a direct current magnetic field is applied to a discharge flow 104 of the molten steel 100 discharged from the discharge holes 103 by for example an electromagnetic brake device (not shown), a counterflow 105 in the opposite direction is generated around the discharge flow 104. As a result, Ar gas bubbles 106 contained in the discharge flow 104 do not easily deeply enter the molten steel 100 within the casting mold 101 due to this counterflow 105. As a result, the number of the Ar gas bubbles 106 can be reduced inside a cast obtained by casting the molten steel 100.

However, since the Ar gas bubbles 106 flow on the counterflow 105 which rises along the submerged entry nozzle 102, is concentrated around the submerged entry nozzle 102 and floats to a meniscus 107, the bubbles may not be removed by the meniscus 107. In this case, some of the Ar gas bubbles 106 are trapped by a solidified shell 108 formed on the internal surface of the casting mold 101. As a result, the number of the Ar gas bubbles 106 in the surface layer of a cast obtained by casting the molten steel 100 is increased.

Thus, in order to prevent the Ar gas bubbles 106 from being trapped by the solidified shell 108 of the casting mold 101, electromagnetically stirring the molten steel 100 in the vicinity of the meniscus 107 in the upper part of the casting mold 101 is proposed. With this electromagnetic stirring, a stirring flow 109 is formed as shown in FIG. 8 for example, in the molten steel 100 in the vicinity of the meniscus 107; therefore, the Ar gas bubbles 106 trapped by the solidified shell 108 can be reduced (refer to Patent Document 1).

[Prior Art Documents]

[Patent Documents]

[Patent Document 1] Japanese Unexamined Patent Application, First Publication No. 2000-271710

SUMMARY OF INVENTION

[Problems to be Solved by the Invention]

However, even in a case where the electromagnetic stirring is used together as described above, the number of the Ar gas bubbles 106 in the surface layer of the cast could not be sufficiently reduced. When the present inventors studied the cause of this, it was found that the Ar gas bubbles 106 are trapped by the solidified shell 108 formed on a long side wall 101*a* in an area 110 between the long side wall 101*a* of the casting mold 101, and the submerged entry nozzle 102. As described above, although the Ar gas bubbles 106 rise along the submerged entry nozzle 102 while flowing on the counterflow 105, some of the Ar gas bubbles 106 are diffused while rising. As a result, as shown in FIG. 9 for example, since the space between the long side wall 101*a* and the submerged entry nozzle 102 is narrow, the Ar gas bubbles 106 will be trapped by the solidified shell 108 on the long side wall 101*a*. Additionally, as shown in FIG. 8, since the space between the long side wall 101*a* and the submerged entry nozzle 102 is narrow, even when the stirring flow 109 is formed by the electromagnetic stirring, the molten steel 100 will not easily flow through the area 110. As a result, the Ar gas bubbles 106 in the molten steel 100 in the area 110 tend to be trapped by the solidified shell 108 on the long side wall 101*a*.

Since the Ar gas bubbles 106 in the area 110 remain on the surface layer of a cast in this way and causes degradation in the strength of the cast or surface roughness in the cast, there is a demand of improvement in the quality of the cast.

The present invention has been made in view of the above circumstances, and has an object of providing a continuous casting apparatus for steel which can reduce Ar gas bubbles contained in a cast made by continuous casting, and can improve the quality of the cast.

DISCLOSURE OF INVENTION

In order to solve the above problems and achieve the relevant object, the present invention adopted the following measures. That is, (1) a continuous casting apparatus for steel of the present invention includes: a casting mold for casting a molten steel, having a pair of long side walls and a pair of short side walls; a submerged entry nozzle which discharges the molten steel into the casting mold; an electromagnetic stirring device arranged along each of the long side walls to stir an upper part of the molten steel within the casting mold; and an electromagnetic brake device arranged below the electromagnetic stirring device to impart a direct current magnetic field, along each of the long side walls, which has a flux density distribution which is uniform in a casting mold width direction in a casting mold thickness direction. A curved portion which is curved toward the electromagnetic stirring device is formed at least at a position where the curved portion faces the submerged entry nozzle on each of the long side walls. The horizontal distance between a top of the curved portion and the submerged entry nozzle in plan view is equal to or more than 35 mm and less than 50 mm.

According to the continuous casting apparatus for steel described in the above (1), the curved portion is formed at least at a position where the curved portion faces the submerged entry nozzle on each of the long side walls of the casting mold. Thus, curved regions can be formed between the curved portions and the submerged entry nozzle. Since the curved regions can be made wider than conventional regions formed between flat walls and a submerged entry nozzle due to formation of the curved portion, a region where the Ar gas bubbles in the molten steel rising along the outer periphery of the submerged entry nozzle and being diffused can be wider.

Meanwhile, when the present inventors carried out an investigation, it was found that trapping of Ar gas bubbles by the solidified shell formed on the long side walls of the casting mold cannot be suppressed only by forming the curved region. Specifically, when the horizontal distance between the top of the curved portion and the submerged entry nozzle in plan view is less than 35 mm, the flow of the molten steel flows less easily in the curved region, and the Ar gas bubbles in the molten steel tend to be trapped by the solidified shell. Additionally, when the horizontal distance is equal to or greater than 50 mm, it would be difficult to secure the uniform flow of the molten steel in the curved region, and the Ar gas bubbles in the molten steel tend to be trapped by the solidified shell in a region where the flow velocity of the molten steel is slow. In this point, according to the present invention, the curved regions are formed such that the horizontal distance becomes equal to or more than 35 mm and less than 50 mm. Therefore, even when the Ar gas bubbles in the molten steel which rise along the submerged entry nozzle are diffused, the Ar gas bubbles can float to a meniscus. Accordingly, the Ar gas bubbles can be inhibited from being trapped by the solidified shell formed on the long side wall of the casting mold. Additionally, since the horizontal distance can be secured by the curved regions, a stirring flow of the molten steel formed by the electromagnetic stirring device easily flows through this curved regions. As a result, the Ar gas bubbles are stirred in the upper part of the casting mold, and can be further inhibited from being trapped by the solidified shell. In this way, since trapping of the Ar gas bubbles in the solidified shell can be inhibited, the Ar gas bubbles contained in the cast can be reduced, and the quality of the cast can be improved.

(2) In the continuous casting apparatus for steel described in the above (1), the curved portion may be formed by curving each of the long side walls outward in the entirety thereof. Alternatively, it is preferable that the curved portion be formed in an internal surface of each of the long side walls, and the external surface of each of the long side walls be a flat surface.

In the above (2), in a case where the curved portion is formed at the internal surface of each of the long side walls, the distance between the curved portion and the electromagnetic stirring device becomes shorter than the distance between portions other than the curved portion of the long side wall, and the electromagnetic stirring device. Then, the molten steel in the curved region between the curved portion and the submerged entry nozzle can be easily stirred. Accordingly, since the Ar gas bubbles in the molten steel in the curved region can be sufficiently stirred, even if the Ar gas bubbles float along the outer periphery of a submerged entry nozzle, the Ar gas bubbles in the curved region can be further inhibited from being trapped by the solidified shell.

[Effect of the Invention]

According to the present invention, Ar gas bubbles contained in the cast can be reduced, and the quality of the cast can be improved.

BEST MODE FOR CARRYING OUT THE INVENTION

Hereinafter, one embodiment of a continuous casting apparatus for steel of the present invention will be described.

Figure 1:
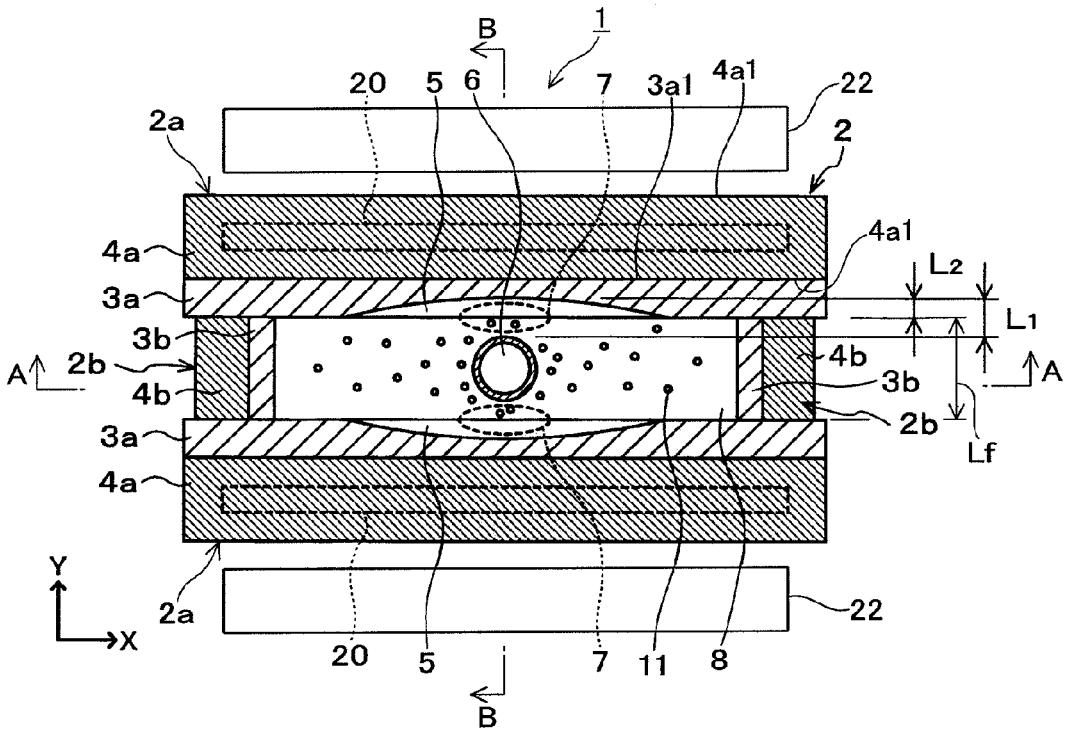
FIG. 1 is a plan sectional view showing a schematic configuration in the vicinity of a casting mold of a continuous casting apparatus related to one embodiment of the present invention.
Figure 2:
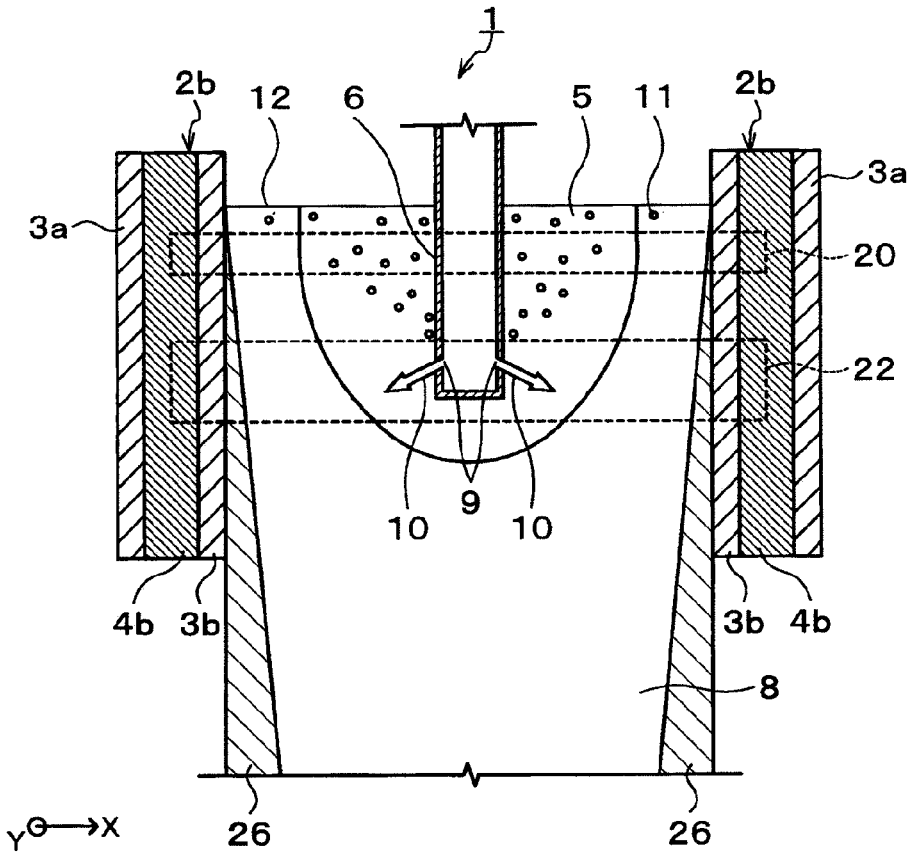
FIG. 2 is a view showing the schematic configuration in the vicinity of the casting mold of the continuous casting apparatus, and is also a vertical sectional view along an arrow A-A of FIG. 1.
Figure 3:
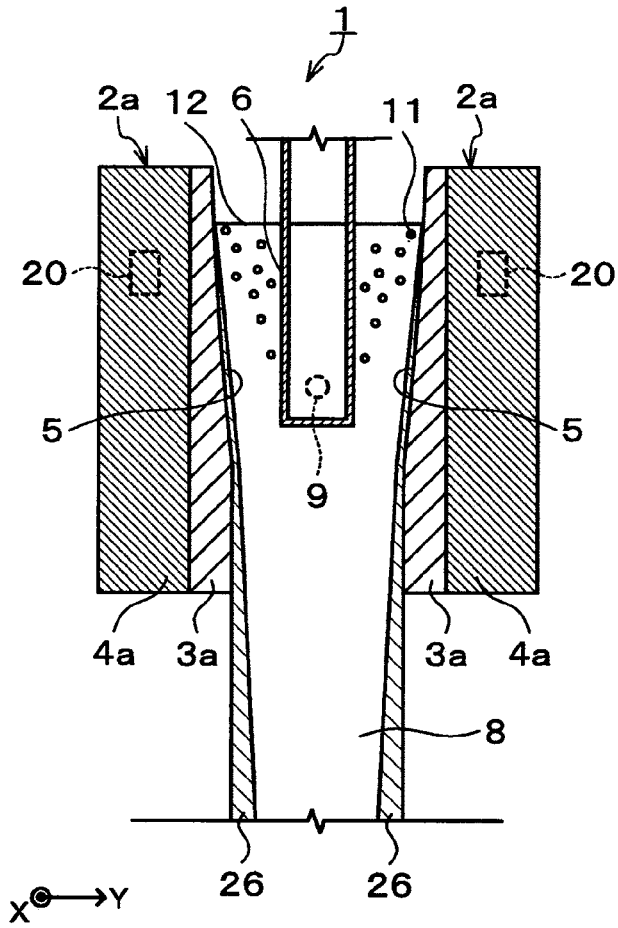
FIG. 3 is a view showing the schematic configuration in the vicinity of the casting mold of the continuous casting apparatus, and is also a vertical sectional view along an arrow B-B of FIG. 1.

FIG. 1 is a plan sectional view showing a schematic configuration in the vicinity of a casting mold of a continuous casting apparatus 1 related to one embodiment of the present invention, and FIGS. 2 and 3 are vertical sectional views showing the configuration in the vicinity of the casting mold of the continuous casting apparatus 1.

As shown in FIG. 1, the continuous casting apparatus 1 has a casting mold 2 whose plan cross-sectional shape is rectangular. The casting mold 2 has a pair of long side walls 2*a* and a pair of short side walls 2*b*. Each of the long side walls 2*a* is formed by a copper plate 3*a* provided on the inside and a stainless steel box 4*a* provided on the outside. Additionally, each of the short side walls 2*b* is formed by a copper plate 3*b* provided on the inside and a stainless steel box 4*b* provided on the outside. In addition, in the present embodiment, the length Lf (casting thickness) of the short side wall 2*b* is, for example, 50 mm to about 300 mm.

Meanwhile, the required width of casts is, about 50 mm to 80 mm for a cast having a thin width, is about 80 mm to 150 mm for a cast having a middle width, and is about 150 mm to 300 mm for a cast having a normal width.

Additionally, the horizontal direction (X direction in FIGS. 1 to 3) along the long side wall 2*a* is referred to as a casting mold width direction, and the horizontal direction (Y direction in FIGS. 1 to 3) along the short side wall 2*b* is referred to as a casting mold thickness direction.

A curved portion 5 which is curved toward the stainless steel box 4*a* (outside of the casting mold 2) is formed at a center position in the casting mold width direction, in the internal surface of the copper plate 3*a* of the long side wall 2*a*.

The curved portion 5 is formed at a position where the curved portion faces a submerged entry nozzle 6 (to be described Teter) provided within the casting mold 2.

Additionally, when it is seen in vertical sectional views shown in FIGS. 2 and 3, the curved portion 5 is formed so as to overlap with the submerged entry nozzle 6 and extends downward from an upper end of the copper plate 3*a*. The position of the lower end of the curved portion 5 may be the same height as the position of the lower end of the submerged entry nozzle 6, or may be a position lower than the position of the lower end of the submerged entry nozzle 6. In addition, the curved portion 5 is formed, for example, by shaving off the internal surface of the copper plate 3*a* in the shape of a concave curve. Also, a curved region 7, as shown in FIG. 1, is formed between the curved portion 5 and the submerged entry nozzle 6.

In addition, it is recommended that the horizontal distance $L_1$ between the curved top of the curved portion 5 and the submerged entry nozzle 6, when the casting mold 2 is seen in plan view, is preferably equal to or more than a predetermined distance, for example, equal to or more than 35 mm, in a viewpoint of securing a distance such that the Ar gas bubbles 11 which will be described below are not trapped by solidified shells 26. This is because, if the horizontal distance $L_1$ is less than 35 mm, the flow of the molten steel 8 flows less easily in the curved region 7, and the Ar gas bubbles 11 within the molten steel 8 tend to be trapped by the solidified shells 26. Additionally, it is recommended that the horizontal distance $L_1$ is less than 50 mm. This is because, if the horizontal distance $L_1$ is equal to or more than 50 mm, it would be difficult to secure the uniform flow of the molten steel 8 in the curved region 7, the flow velocity of the molten steel 8 would be slow, and the Ar gas bubbles 11 in the molten steel 8 would be trapped easily by the solidified shells 26.

Additionally, the curving distance $L_2$ (the shortest horizontal distance between the curved top and both ends in the curved portion 5, and also the shave-off depth to form the curved portion 5) of the curved portion 5 is not particularly specified if a predetermined distance can be secured for the horizontal distance $L_1$, and is appropriately determined according to the external diameter of the submerged entry nozzle 6 or the thickness of the casting mold 2. Here, it is preferable that the curving distance $L_2$ of the curved portion 5 be smaller in a viewpoint of preventing distortion while drawing a cast. In addition, in the present embodiment, the difference ($L_1$–$L_2$) between the horizontal distance $L_1$ and the curving distance $L_2$ becomes less than a predetermined distance (for example, less than 40 mm). Additionally, an external surface 3*a*1 of the copper plate 3*a* of the long side wall 2*a* and both surfaces 4*a*1 of the stainless steel box 4*a* are formed flat.

As shown in FIGS. 2 and 3, the submerged entry nozzle 6 is provided in an upper position within the casting mold 2. A lower part of the submerged entry nozzle 6 is submerged within the molten steel 8 within the casting mold 2. Discharge holes 9 which discharge the molten steel 8 obliquely downward into the casting mold 2 are fowled in two places in the vicinity of a lower end of the lateral side of the submerged entry nozzle 6. The discharge holes 9 are formed so as to face the short side walls 2*b* of the casting mold 2. The Ar gas bubbles 11 or the like for cleaning the inside of the submerged entry nozzle 6 are contained in a discharge flow 10 discharged from each of the discharge holes 9.

As shown in FIGS. 1 to 3, a pair of electromagnetic stirring devices 20 such as electromagnetic stirring coils, is provided at the height in the vicinity of the height of the meniscus 12, within the stainless steel boxes 4*a* of the long side walls 2*a* of the casting mold 2. Each electromagnetic stirring device 20 is arranged so as to be parallel to both the surfaces 4*a*1 of the stainless steel box 4*a*.

Figure 4:
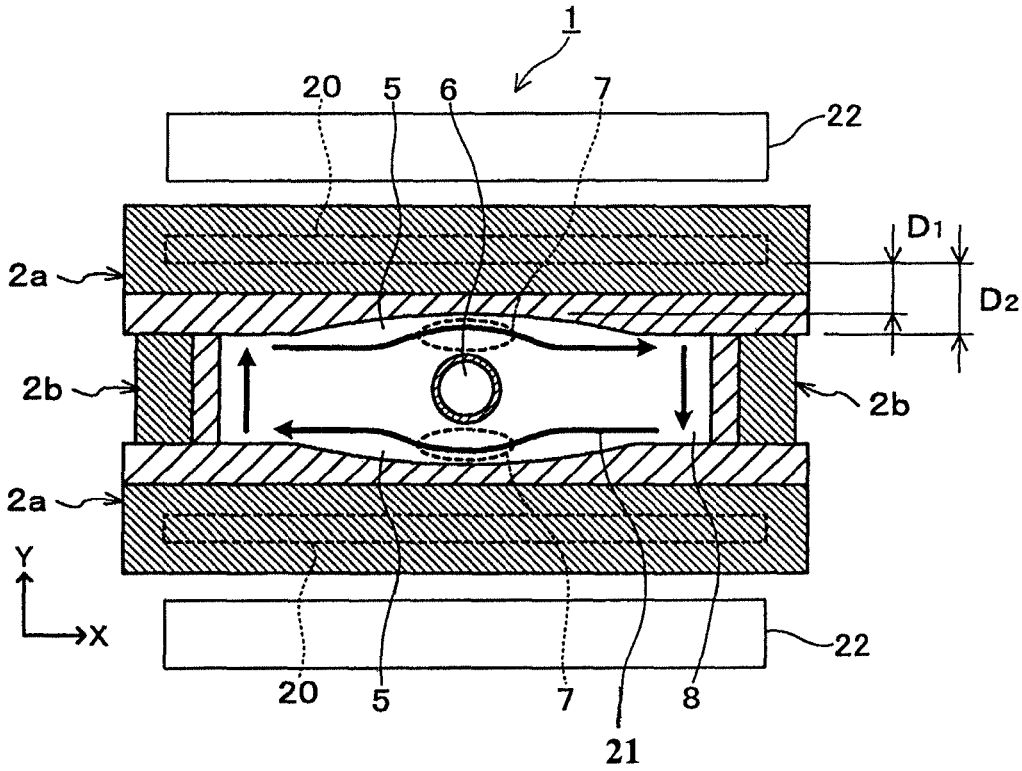
FIG. 4 is a view illustrating the flow of molten steel in a casting mold upper part when an electromagnetic stirring device of the continuous casting apparatus is operated, and is also a plan sectional view equivalent to FIG. 1.

As shown in FIG. 4, the molten steel 8 in the vicinity of the meniscus 12 within the casting mold 2 can be circulated (i.e., the molten steel 8 in plan view is circulated about the submerged entry nozzle 6) in the horizontal direction by the electromagnetic stirring of the electromagnetic stirring device 20 to form a stirring flow 21. Meanwhile, the curved region 7 is formed so as to be wider than a conventional region formed by a flat wall which forms a linear shape in plan view, as much as the curved portion. Therefore, the flow of the molten steel will not stagnate between each long side wall and the submerged entry nozzle unlike the related art, and the stirring flow 21 is circulated around the submerged entry nozzle 6 along the internal surfaces of the long side wall 2*a* and the short side wall 2*b*. Additionally, the distance $D_1$ between the curved top of the curved portion 5 and the electromagnetic stirring device 20 when the casting mold 2 is seen in a plan sectional view becomes shorter than the distance $D_2$ between portions other than the curved portion 5 of the internal surface of the copper plate 3*a*, and the electromagnetic stirring device 20. As a result, since the molten steel 8 in the curved region 7 is close to the electromagnetic stirring device 20 in addition to the fact that the curved region 7 will not be narrow as a flow channel for the stirring flow 21, the molten steel tends to be stirred more compared to the related art.

As shown in FIG. 2, a pair of electromagnetic brake devices 22, such as electromagnets, is provided below the electromagnetic stirring devices 20. The position of the centerline of each electromagnetic brake device 22 (position of a maximum magnetic flux density) is located below the discharge holes 9 of the submerged entry nozzle 6.

Figure 5:
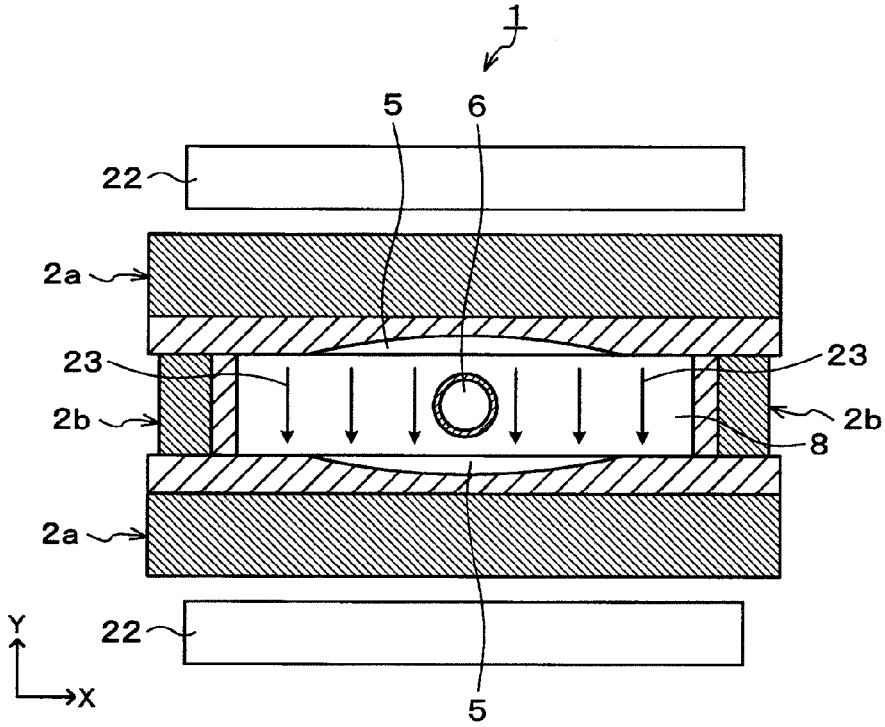
FIG. 5 is a view illustrating a direct current magnetic field when an electromagnetic brake device of the continuous casting apparatus is operated, and is also a plan sectional view equivalent to FIG. 1.
Figure 6:
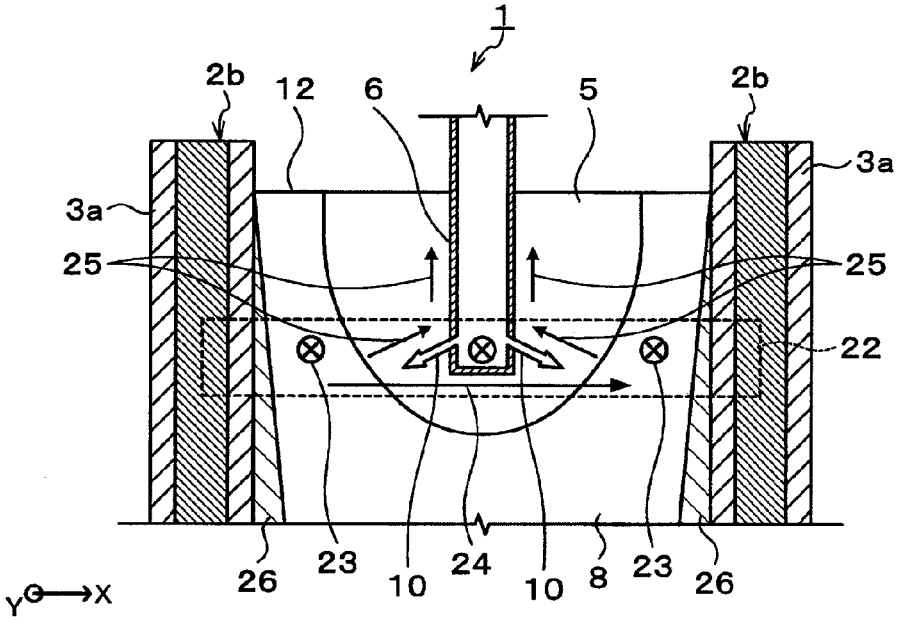
FIG. 6 is a view illustrating the flow of a direct current magnetic field, induced current, and counterflow when the electromagnetic brake device is operated, and is also a sectional view equivalent to an upper portion of FIG. 2.
Figure 7:
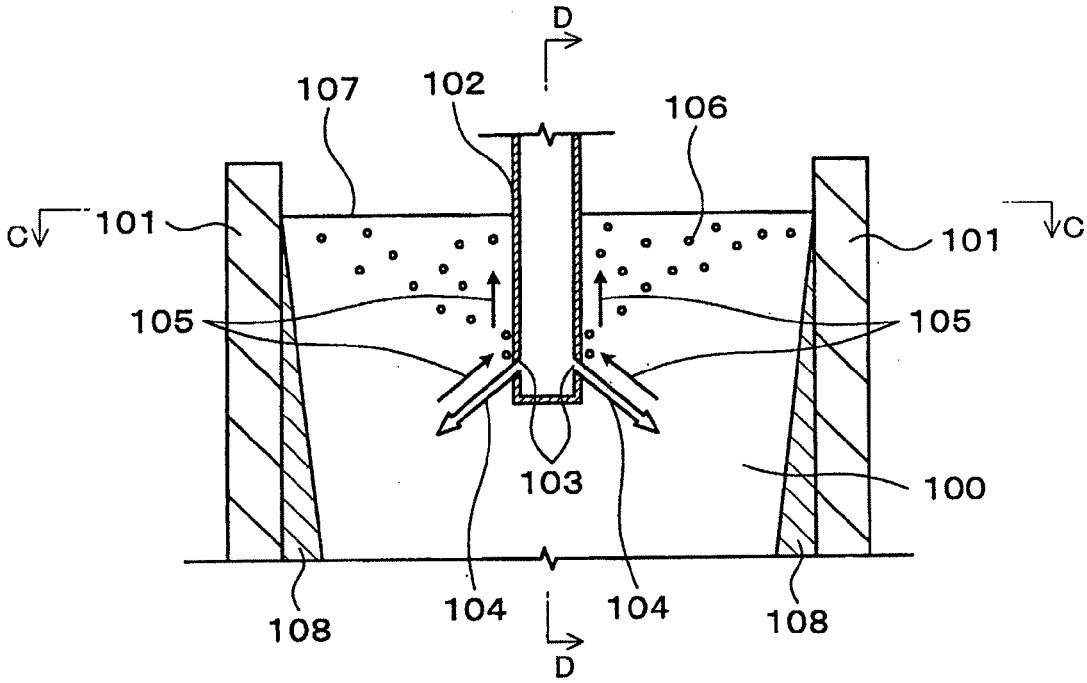
FIG. 7 PRIOR ART
FIG. 7 is a vertical sectional view showing a schematic configuration in the vicinity of a casting mold of a conventional continuous casting apparatus.
Figure 8:
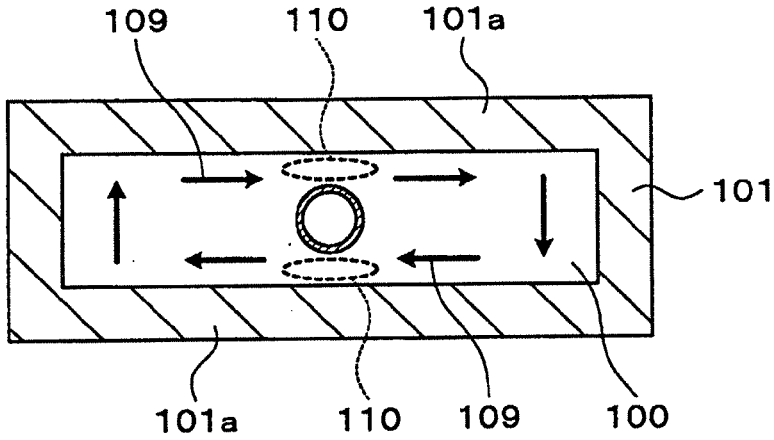
FIG. 8 PRIOR ART
FIG. 8 is a view showing the schematic configuration in the vicinity of the casting mold, and is a plan sectional view along an arrow C-C of FIG. 7.
Figure 9:
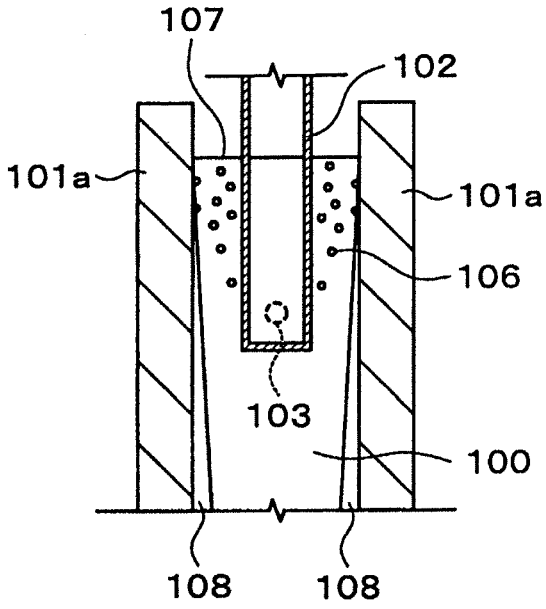
FIG. 9 is a view showing the schematic configuration in the vicinity of the casting mold, and is a vertical sectional view along an arrow D-D of FIG. 7.

As shown in FIG. 5, the electromagnetic brake device 22 is provided outside the long side wall 2*a* of the casting mold 2. As shown in FIGS. 5 and 6, the electromagnetic brake device 22 applies a direct current magnetic field 23, which has a flux density distribution which is substantially uniform in the casting mold width direction (the X direction in FIG. 5) along the internal surface of the long side wall 2*a* of the casting mold 2, to the discharge flow 10 of the molten steel 8 immediately after being discharged from the discharge holes 9, in the casting mold thickness direction (the Y direction in FIG. 5) along the internal surface of the short side 2*b* of the casting mold 2. An induced current 24, as shown in FIG. 6, is generated in the casting mold width direction (the X direction in FIG. 6) along the internal surface of the long side wall 2*a* of the casting mold 2 by the direct current magnetic field 23 and the discharge flow 10 of the molten steel 8 discharged from the discharge holes 9. In addition, a counterflow 25 is formed in the direction opposite to the discharge flow 10, in the vicinity of the discharge flow 10 by the induced current 24 and the direct current magnetic field 23. The counterflow 25 moves toward and collides with the submerged entry nozzle 6 at almost the same angle as the discharge angle of the discharge flow 10, and rises to the meniscus 12 along the outer peripheral surface of the submerged entry nozzle 6.

In addition, as shown in FIGS. 2 and 3, the solidified shell 26 is formed on the internal surface of the casting mold 2, in which the molten steel 8 was cooled and solidified.

The continuous casting apparatus 1 related to the present embodiment is configured as described above. Next, a continuous casting method for the molten steel 8 using the continuous casting apparatus 1 will be described.

First, the molten steel 8 is discharged into the casting mold 2 from the discharge holes 9 of the submerged entry nozzle 6 while blowing Ar gas into the submerged entry nozzle 6.

Since the molten steel 8 is discharged obliquely downward from the discharge holes 9, the discharge flow 10 is formed which heads from the discharge holes 9 toward the short side wall 2*b* of the casting mold 2. The Ar gas bubbles 11 are contained in the discharge flow 10, and the Ar gas bubbles 11 float in the molten steel 8 within the casting mold 2.

The molten steel 8 is discharged from the submerged entry nozzle 6, and simultaneously, the electromagnetic brake device 22 is operated. The counterflow 25 in the direction opposite to the flow of the discharge flow 10 is formed by the direct current magnetic field 23 formed by the electromagnetic brake device 22. The counterflow 25 rises toward the meniscus 12 after colliding with the submerged entry nozzle 6. Also, the Ar gas bubbles 11 which are floating in the molten steel 8 also flow on the counterflow 25, and float to the vicinity of the meniscus 12.

Simultaneously with the operation of the above-described electromagnetic brake device 22, the electromagnetic stirring device 20 is also operated. The stirring flow 21 is formed in the molten steel 8 in the vicinity of the meniscus 12 within the casting mold 2 by the electromagnetic stirring by the electromagnetic stirring device 20. Then, the Ar gas bubbles 11 which have flowed on the counterflow 25 and have floated to the vicinity of the meniscus 12 are circulated around the submerged entry nozzle 6 by the stirring flow 21, and are incorporated and removed into continuous casting powder (not shown) which has melting oxides for example, without being trapped by the solidified shell 26 on the casting mold 2.

Thereafter, the molten steel 8 from which the Ar gas bubbles 11 have been removed in this way is solidified and is casted into a cast.

According to the present embodiment described above, the curved region 7 is formed between the curved portion 5 and the submerged entry nozzle 6 by forming the curved portion 5 at the top central position of the long side wall 2*a* of the casting mold 2. Since the horizontal distance $L_1$ is secured by the curved region 7, even when the Ar gas bubbles 11 which flow on the counterflow 25 and rise along with the submerged entry nozzle 6 are diffused, the Ar gas bubbles 11 can float to the meniscus 12. Accordingly, the Ar gas bubbles 11 can be kept away from the solidified shell 26 formed on the internal surfaces of the long side wall 2*a* of the casting mold 2, and can be inhibited from being trapped by the solidified shell 26. That is, as shown in FIGS. 2 and 3, since the curved portion 5 forms a curved concave surface which spreads vertically upward from the lower position of the submerged entry nozzle 6, two curved regions 7 which spread vertically upward from the lower position of the submerged entry nozzle 6 are formed between the submerged entry nozzle 6 and the respective long side walls 2*a*.

Also, since the horizontal distance $L_1$ is secured by the formation of the curved regions 7, the stirring flow 21 formed by the electromagnetic stirring device 20 tends to flow easily in the curved regions 7. As a result, the Ar gas bubbles 11 are stirred in the upper part of the casting mold 2, and can be further inhibited from being trapped by the solidified shell 26. Since the Ar gas bubbles 11 can be inhibited from being trapped by the solidified shell 26 in this way, the Ar gas bubbles 11 contained in a cast can be reduced, and the quality of the cast can be improved.

Additionally, since the curved portion 5 is formed in the internal surface of the copper plate 3*a* of the long side wall 2*a*, and the external surface of the copper plate 3*a* is formed as a flat surface, the distance $D_1$ between the curved top of the curved portion 5 and the electromagnetic stirring device 20 becomes shorter than the distance $D_2$ between the internal surface of the copper plate 2*a* outside the curved portion 5 and the electromagnetic stirring device 20. As a result, although the molten steel 8 in the curved region 7 has to pass through a narrow channel as for the stirring flow 21, the molten steel can be simultaneously stirred easily. Accordingly, since the Ar gas bubbles 11 in the molten steel 8 in the curved region 7 can be sufficiently stirred within the casting mold 2, even when the Ar gas bubbles 11 float along the outer peripheral surface of the submerged entry nozzle 6, the Ar gas bubbles 11 of the curved region 7 can be further inhibited from being trapped by the solidified shell 26.

Additionally, with the direct current magnetic field 23 applied by the electromagnetic brake device 22, the counterflow 25 in the direction opposite to the discharge flow 10 discharged from the discharge holes 9 into the casting mold 2 is formed in the vicinity of the discharge flow 10. Thereby, the Ar gas bubbles 11 in the discharge flow 10 do not enter the molten steel 8 in the casting mold 2 deeply. As a result, the Ar gas bubbles 11 contained inside a cast can be reduced.

EXAMPLE 1

Hereinafter, the effects of removing Ar gas bubbles contained in molten steel when the continuous casting apparatus for steel of the present invention is used will be described. In the present example, the continuous casting apparatus 1 previously shown in FIGS. 1 to 3 is used as the continuous casting apparatus for steel. In addition, in the present example, the effects of removing inclusions contained in molten steel in addition to the Ar gas bubbles were also evaluated.

As for the casting mold 2 of the continuous casting apparatus 1, a casting mold having the width of 1200 mm, the height of 900 mm, and the thickness of 250 mm was used. A vertical portion (not shown) whose length is 2.5 m and a bent portion (not shown) whose bending radius is 7.5 m are provided in this order from the top below the casting mold 2.

The electromagnetic stirring device 20 is 150 mm in the height and is 100 mmFe in thrust, and the upper end thereof is provided at the same height position as the meniscus 12.

The electromagnetic brake device 22 is provided such that the centerline position thereof (namely, a position for a maximum magnetic flux density) is set to a position where is 500 mm depth from the meniscus 12.

Low-carbon aluminum-killed steel was used as the molten steel 8, and casting of steel was performed under the conditions that casting velocity is 2 m/min (0.033 m/sec).

A nozzle having the external diameter of 150 mm and the internal diameter of 90 mm was used as the submerged entry nozzle 6. The center positions of the discharge holes 9 of the submerged entry nozzle 6 are provided at the same depth position of 300 mm from the meniscus 12. Two circular discharge holes 9 are formed in the submerged entry nozzle 6 so as to face the short side walls 2*b* of the casting mold 2. The diameter of the discharge holes 9 is 60 mm, and the discharge angle θ of the discharge holes 9 is 30 degrees downward from the horizontal surface as seen in the vertical section of FIG. 2. Additionally, when the discharge holes are seen in plan view, the discharge directions of the two discharge holes 9 are mutually opposite directions of 180 degrees around the centerline of the submerged entry nozzle 6.

In the continuous casting apparatus 1 described above, casting of steel was conducted under five conditions where the horizontal distances $L_1$ between the curved top of the curved portion 5 of the casting mold 2, and the submerged entry nozzle 6 are 30 mm, 35 mm, 40 mm, 45 mm, and 50 mm.

Additionally, in a case where the horizontal distance $L_1$ is 30 mm, the curving distance $L_2$ of the curved portion 5 was changed between 0 mm and 5 mm; and in a case where the horizontal distance $L_1$ is equal to or more than 35 mm, the curving distance $L_2$ was changed to 5 mm, 10 mm, 15 mm, and 20 mm in correspondence with changes in the horizontal distance $L_1$. Moreover, the curving distance $L_2$ of 0 mm indicates a state where the curved portion 5 is not formed in the long side wall 2*a* of the casting mold 2.

Also, in the casted casts, the number of the Ar gas bubbles 11 and inclusions which have a diameter of 100 μm or more and are contained in a surface layer with a depth of 50 mm from each surface was counted. This counting is performed to confirm the influence on the quality of the casts, of the Ar gas bubbles and inclusions which have a diameter of 100 μm or more contained in the surface layer with a depth of 50 mm from the surface of each cast.

The results when casting was performed under the above conditions are shown in Table 1. In Table 1, the index of the number of the Ar gas bubbles shows the ratio of the number of Ar gas bubbles under the respective conditions when the number of Ar gas bubbles in a case where the horizontal distance $L_1$ is 30 mm and the curving distance $L_2$ is 0 mm (that is, the curved portion 5 is not formed) is defined as 1. Additionally, the index of number of inclusions shows the ratios of the number of inclusions under the respective conditions when the number of inclusions in a case where the horizontal distance $L_1$ is 30 mm and the curving distance $L_2$ is 0 mm is defined as 1.

As shown in Table 1, in a case where the horizontal distance $L_1$ is 30 mm, it was found that, even when the curved portion 5 is formed with the curving distance $L_2$ being 5 mm, both the index of the number of Ar gas bubbles and the index of number of inclusions are still 1, and the number of Ar gas bubbles and inclusions cannot be reduced.

Additionally, in a case where the horizontal distance $L_1$ is 50 mm, even when the curved portion 5 is formed with the curving distance $L_2$ being 20 mm, the index of the number of Ar gas bubbles becomes very close to 1, and the index of the number of inclusions becomes larger than 1. Hence, it was found that the number of Ar gas bubbles and inclusions cannot be sufficiently reduced.

On the other hand, in a case where the horizontal distance $L_1$ is 35 mm, 40 mm, and 45 mm, and the curved portion 5 is formed, it was confirmed that the index of the number of Ar gas bubbles and the index of number of inclusions become less than 1 and the number of Ar gas bubbles and inclusions is reduced. Accordingly, it was found that, when molten steel was casted using the continuous casting apparatus of the present invention, Ar gas bubbles and inclusions can be appropriately removed, and the quality of a cast can be improved.

TABLE 1

| Distance between Curved Portion and Submerged entry nozzle, $L_1$ (mm) | Curving Distance of Curved Portion $L_2$, (mm) | Index of Number of Ar Gas Bubbles | Index of Number of Inclusions |
|---|---|---|---|
| 30 | 0 | 1 | 1 |
| 30 | 5 | 1 | 1 |
| 35 | 5 | 0.5 | 0.6 |
| 40 | 10 | 0.2 | 0.3 |
| 45 | 15 | 0.1 | 0.2 |
| 50 | 20 | 0.9 | 1.1 |

The technical scope of the present invention is not limited to the above-described embodiment only, and various modifications of the above-described embodiment may be made without departing from the concept of the present invention. That is, the specific processing and configurations mentioned in the present embodiment are no more than examples and can be appropriately changed.

For example, in the continuous casting apparatus for steel of the present invention, each of the long side walls 2*a* may be curved to the outside of the casting mold 2 in the entirety thereof, thereby forming the curved portion 5.

INDUSTRIAL APPLICABILITY

According to the present invention, it is possible to provide a continuous casting apparatus for steel which can reduce Ar gas bubbles contained in a cast which has been continuously casted, and can improve the quality of the cast.

[Description of Reference Symbols]

| | |
|---|---|
| 1: | CONTINUOUS CASTING APPARATUS |
| 2: | CASTING MOLD |
| 2a: | LONG SIDE WALL |
| 2b: | SHORT SIDE WALL |
| 3a, 3b: | COPPER PLATE |
| 4a, 4b: | STAINLESS STEEL BOX |
| 5: | CURVED PORTION |
| 6: | SUBMERGED ENTRY NOZZLE |
| 7: | CURVED REGION |
| 8: | MOLTEN STEEL |
| 9: | DISCHARGE HOLE |
| 10: | DISCHARGE FLOW |
| 11: | Ar GAS BUBBLE |
| 12: | MENISCUS |
| 20: | ELECTROMAGNETIC STIRRING DEVICE |
| 21: | STIRRING FLOW |
| 22: | ELECTROMAGNETIC BRAKE DEVICE |
| 23: | DIRECT CURRENT MAGNETIC FIELD |
| 24: | INDUCED CURRENT |
| 25: | COUNTERFLOW |
| 26: | SOLIDIFIED SHELL |

The invention claimed is:

1. A continuous casting apparatus for steel comprising:

a casting mold for casting a molten steel, having a pair of long side walls and a pair of short side walls;

a submerged entry nozzle which discharges the molten steel into the casting mold;

an electromagnetic stirring device arranged along each of the long side wails to stir an upper part of the molten steel within the casting mold; and an electromagnetic brake device arranged below the electromagnetic stirring device to impart a direct current magnetic field in a casting mold thickness direction, which is along the short side walls, the direct current magnetic field having a flux density distribution which is uniform in a casting mold width direction, which is along each of the long side walls, wherein a curved portion which is curved toward the electromagnetic stirring device is formed at least at a position where the curved portion faces the submerged entry nozzle on each of the long side walls, wherein the horizontal distance between a top of the curved portion and the submerged entry nozzle in plan view is equal to or more than 35 mm and less than 50 mm, wherein the curved portion is formed in an internal surface of each of the long side walls, the external surface of each of the long side walls is a flat surface, and wherein the curved portion is formed at a top central position of the internal surface of each of the long side walls.

* * * * *